US005560458A

United States Patent [19]

Franklin et al.

[11] Patent Number: 5,560,458

[45] Date of Patent: Oct. 1, 1996

[54] WHEELED LUGGAGE WITH SELECTIVELY POSITIONABLE MANEUVERING AND CARRYING HANDLE AND AUXILIARY LUGGAGE AND HANDLE RESTRAINT

[75] Inventors: Dana Franklin; Bonnie M. Earl, both of Denver, Colo.

[73] Assignee: Samsonite Corporation, Denver, Colo.

[21] Appl. No.: 184,543

[22] Filed: Jan. 21, 1994

[51] Int. Cl.[6] ..... A45C 5/14; A45C 13/30

[52] U.S. Cl. ..... 190/115; 190/18 A; 190/39; 190/102; 190/108; 16/115; 280/37

[58] Field of Search ..... 190/18 A, 102, 190/115, 117, 39, 108; 280/37, 655, 655.1, 47.29; 16/115

[56] References Cited

U.S. PATENT DOCUMENTS

| | | | |
|---|---|---|---|
| 627,173 | 4/1901 | LeFevre . | |
| 910,288 | 1/1909 | Shaw . | |
| 1,084,360 | 1/1914 | Rahm . | |
| 1,916,793 | 7/1933 | Harper . | |
| 2,372,845 | 4/1945 | Nelson . | |
| 2,581,417 | 1/1952 | Jones . | |
| 2,707,035 | 4/1955 | Lashley . | |
| 3,257,120 | 6/1966 | Browning | 190/18 A X |
| 3,522,955 | 8/1970 | Warner, Jr. . | |
| 3,564,590 | 2/1971 | Hebel . | |
| 3,606,372 | 9/1971 | Browning . | |
| 3,895,696 | 7/1975 | Urushibara . | |
| 3,958,731 | 5/1976 | Riedle . | |
| 4,256,320 | 3/1981 | Hager . | |
| 4,383,141 | 5/1983 | Walker . | |
| 4,621,404 | 11/1986 | Browning . | |
| 4,759,431 | 7/1988 | King et al. . | |
| 4,838,396 | 6/1989 | Krenzel | 190/18 A |
| 4,995,487 | 2/1991 | Plath . | |
| 5,027,874 | 7/1991 | Gazzola | 190/115 X |
| 5,108,119 | 4/1992 | Haung . | |
| 5,253,739 | 10/1993 | King . | |
| 5,355,980 | 10/1994 | Hsieh | 190/115 |

FOREIGN PATENT DOCUMENTS

| | | | |
|---|---|---|---|
| 2441358 | 6/1980 | France . | |
| 2676628 | 11/1992 | France | 190/115 |
| 729305 | 12/1942 | Germany . | |
| 215158 | 10/1993 | Taiwan . | |
| WO93/19636 | 10/1993 | WIPO . | |
| 9324029 | 12/1993 | WIPO | 190/18 A |

OTHER PUBLICATIONS

Advertisement–Leerblad, Sept. 1993, p. 96.

*Primary Examiner*—Sue A. Weaver

*Attorney, Agent, or Firm*—Gregory W. O'Connor; Rod D. Baker

[57] ABSTRACT

A handle and restraint assembly is for carries and maneuvering a main luggage case having wheels. An extendable handle is moveable into a fully extended position, a fully retracted position, and a selected intermediate position. A restraint device is operatively connected to the handle to selectively restrain the handle in the extended and retracted positions. The restraint device includes a selectively extendable elongated flexible belt by which to connect an auxiliary luggage case for carrying on the main case. The elongated flexible element is extendable for connection to the handle, and may restrain the handle in an intermediate position for carrying the case or for pulling the case on the wheels. A first clutch controls the extension, retraction and retention of the belt, and a second clutch controls the extension, retraction and retention of the handle. The first and second clutches are separately operable independently or they are interconnected to operate simultaneously.

24 Claims, 9 Drawing Sheets

WHEELED LUGGAGE WITH SELECTIVELY POSITIONABLE MANEUVERING AND CARRYING HANDLE AND AUXILIARY LUGGAGE AND HANDLE RESTRAINT

This invention relates to wheeled luggage and more particularly, to a new and improved assembly of a maneuvering and carrying handle and an auxiliary luggage attachment and handle restraint which allows the handle to be extended to selective different lengths for carrying or maneuvering the luggage and which allows the auxiliary luggage to be attached for transportation on a face panel of the main luggage as it is maneuvered on its wheels.

BACKGROUND OF THE INVENTION one of the most popular recent conveniences in the field of wheeled luggage is exemplified in U.S. Pat. No. 4,759,431, assigned to the assignee hereof. This type of luggage includes a luggage case with wheels aligned on a common axis along one bottom edge of the case. An extendable pull handle is connected to the case. The user extends and grasps the pull handle, levers the case into a position where only the wheels touch a support surface, and pulls the case on its wheels by the extended handle. With the case levered into this rolling position, much of the weight of the case is balanced over the wheels so very little effort on the handle is required to maintain the case in the rolling position. The wheels withstand most of the weight, and it is very easy to move the case. Because the wheels are located along a common rotational axis at one bottom edge of the case, the case is also very maneuverable. After pulling the case on its wheels, the pull handle is inserted or retracted into the case.

A conventional carrying handle separate from the pull handle is available to carry the case in the conventional manner, rather than roll it on its wheels. When carrying the case, the pull handle is retracted to allow the case to be carried with the weight of the case and its contents suspended from the carrying handle in the conventional manner.

Rolling the case on its wheels and carrying the case while suspended from the carrying handle are essentially two separate functions. The carrying handle must support the weight of the case and its contents and do so in a way that maintains the balance of the case so that it can be easily suspended at the side of the person carrying it. In order to balance the case for carrying, the carrying handle must be located at the top of the case. The carrying handle must also be connected internally to a frame structure capable of supporting the weight of the case and its contents.

On the other hand, the pull handle is not intended for lifting the case, but is extended only to maneuver the case on its wheels. The pull handle must be sufficiently extendable and have a substantial enough connection and interaction with the case to allow the case to be tilted or levered onto its wheels, to maintain the case in the position over the wheels, and to direct the case by pulling it. The pull handle should also have enough strength to allow the case to be maneuvered up and down stairs and over street curbs. For these and other reasons, the pull handle is typically located on the side of the case above the wheels and is connected integrally enough with the case to transfer the levering force throughout the case.

Connecting the pull handle to the case in this manner is easier in a hard-sided luggage case than a soft-sided luggage case. In a hard-sided case, the relative rigidity of the case shells or halves comprise part of the internal structure to support, lever and pull the case by both the carrying handle and the pull handle. However, in soft-sided cases, the flexible exterior panels offer little or no structural integrity, and therefore an internal frame structure must be provided. The internal frame structure can be somewhat extensive in order to adequately accommodate a carrying handle, a separate pull handle and the wheels. Generally, the internal frame structure in soft-sided cases requires structural members around the internal periphery of the bag to support the weight of the bag from the carrying handle. Structural members are also required along one of the major exterior face panels of the case to connect to and support the pull handle. In some cases, the added complexity of the internal frame structure to provide both carrying and wheeled pulling capability substantially diminishes the advantages of lighter weight and flexibility associated with soft-sided luggage.

Perhaps one of the most important conveniences of wheeled luggage using an extendable pull handle has been the incorporation of an auxiliary luggage carrying capability. To obtain this capability, the auxiliary luggage is attached to the wheeled main luggage case and is supported on an upward facing exterior face panel of the tilted main luggage case when it is pulled on its wheels. The typical attachment technique involves extending a hook, strap or belt around the carrying handle of the auxiliary case to suspend it against the upward tilted exterior face panel of the main luggage case while the main case is pulled on its wheels.

Most of the auxiliary luggage attachment mechanisms described in U.S. Pat. No. 4,759,431 are functionally associated with the extendable pull handle. An attachment strap is connected to the pull handle and is exposed by the extension of the pull handle from its retracted position. The attachment strap is placed through the carrying handle of the auxiliary luggage, and then connected back to the pull handle near the point where the user grasps the pull handle. Thus, the pull handle must be extended to attach the auxiliary luggage.

If the attachment strap is not used to connect to auxiliary luggage, it is placed or folded into a middle portion of the pull handle. It is also necessary to place or fold the attachment strap into the middle portion of the pull handle when retracting the pull handle back into the interior of the case. Attempts to retract the pull handle with the attachment strap extended therefrom and connected to auxiliary luggage can cause obvious difficulties inconsistent with the intended operation.

Furthermore, the extension of the attachment strap from near the extended end of the pull handle to the carrying handle of the auxiliary luggage case may result in reduced stability of the auxiliary luggage, possibly making it difficult to maintain the position of the auxiliary luggage on the main case as the case rolls over uneven terrain. Furthermore, it may also be difficult to attach the auxiliary case to the main case when the pull handle is extended.

U.S. Pat. No. 4,759,431 also discloses an embodiment where the pull handle is separate from an exposed auxiliary attachment belt. The exposed attachment belt lacks the appeal and utility of the combined pull handle and attachment belt because the attachment belt is always exposed and poses the possibility of disconnecting from the case when not in use. Use of the separate attachment belt may also become inconvenient because of its lack of integrated functionality with the pull handle.

It is with respect to these considerations and others associated with wheeled luggage cases having an extendable pull handle and auxiliary luggage attachment capability that the present invention has evolved.

SUMMARY OF THE INVENTION

Some of the important features of the present invention include improving, simplifying and making more convenient, the use of a wheeled luggage case having a selectively extendable and retractable pull or maneuvering handle and a restraint to attach auxiliary luggage to the case and to support the auxiliary luggage case on an exterior upturned face panel of the main luggage case. More specifically, the important features of the present invention involve allowing the auxiliary luggage to be attached to the case without extending or using the pull or maneuvering handle, using a single handle as both a carrying handle and a pull handle, permitting the handle to be extended a selected amount intermediate of its maximally extended position to either pull or carry the case, and selectively fixing the extendable and retractable handle in the best position for a particular user to pull the luggage case on its wheels.

Some of the important features of the present invention include improving, simplifying and making more convenient, the use of a wheeled luggage case having a selectively extendable and retractable pull or maneuvering handle and a restraint to attach auxiliary luggage to the case and to support the auxiliary luggage case on an exterior upturned face panel of the main luggage case. More specifically, the important features of the present invention involve allowing the auxiliary luggage to be attached to the case without extending or using the pull or maneuvering handle, using a single handle as both a carrying handle and a pull handle, permitting the handle to be extended a selected amount intermediate of its maximally extended position to either pull or carry the case, and selectively fixing the extendable and retractable handle in the best position for a particular user to pull the luggage case on its wheels.

To achieve these and other important aspects, the present invention relates to a new and improved handle and restraint assembly for carrying and maneuvering a main luggage case having wheels. A handle is connected to the case and is selectively extendable into a fully extended position, a fully retracted position, and a selected intermediate position between the fully extended and the fully retracted positions. The handle includes a handpiece for gripping the handle to carry the case and to maneuver the case on the wheels. A restraint device is operatively connected to the handle to selectively restrain the handle in the fully extended position in which to maneuver the case on the wheels and in a intermediate position for carrying the case. The restraint device is also capable of selectively restraining the handle in an intermediate position for pulling the case on the wheels. The restraint device may include a selectively extendable elongated flexible element for connecting an auxiliary luggage case to the main case to carry the auxiliary case on the main case when maneuvering the main case on the wheels. The elongated flexible element is extendable for connection to the handle, and may restrain the handle in an intermediate position for carrying the case or for pulling the case on the wheels. A first clutch mechanism may be operatively connected to the elongated flexible element for controlling extension, retraction and retention of the elongated flexible element, and a second clutch mechanism may be operatively connected to the handle for controlling extension, retraction and retention of the handle. The first and second clutch mechanisms are separately operable to independently control the extension, retraction and retention of the elongated flexible element and the handle, respectively, or they are interoperatively connected to simultaneously control the extension, retraction and retention of the elongated flexible element and the handle, respectively.

To achieve the above and other important aspects, the present invention relates to a new and improved method of carrying and maneuvering a main luggage case having wheels. The method involves connecting a handle to the case to for moving to a fully extended position, to a fully retracted position, and to a selected intermediate position between the fully extended and the fully retracted positions. The method also involves restraining the handle in the fully extended position and maneuvering the case on the wheels while the handle is restrained in the fully extended position, restraining the handle in a selected intermediate position and carrying the case by the handle while the handle is restrained in the intermediate position, and restraining the handle in the fully retracted position when not carrying the case and maneuvering the case on the wheels. The case may also be maneuvered or pulled on the wheels while the handle is restrained in the selected intermediate position. An elongated flexible element may be selectively extended from the case, connected to an auxiliary luggage case, and the auxiliary case carried on the main case when maneuvering the main case on the wheels. The elongated flexible element is connected to the handle to restrain the handle in an intermediate position for carrying the case or for maneuvering the case on the wheels. The extension, retraction and retention of the elongated flexible element is controlled by restraining the flexible element, and the extension, retraction and retention of the handle is controlled by restraining the handle. The extension, retraction and retention of the elongated flexible element may occur independently of or simultaneously with the extension, retraction and retention of the handle.

A more complete appreciation for the various improved aspects and features of the present invention, the nature of the present invention itself, and the scope of the present invention can be obtained from the following drawings which are briefly summarized below, from the following detailed description of a presently preferred embodiment of the invention, and from the appended claims.

DETAILED DESCRIPTION

Figure 1:
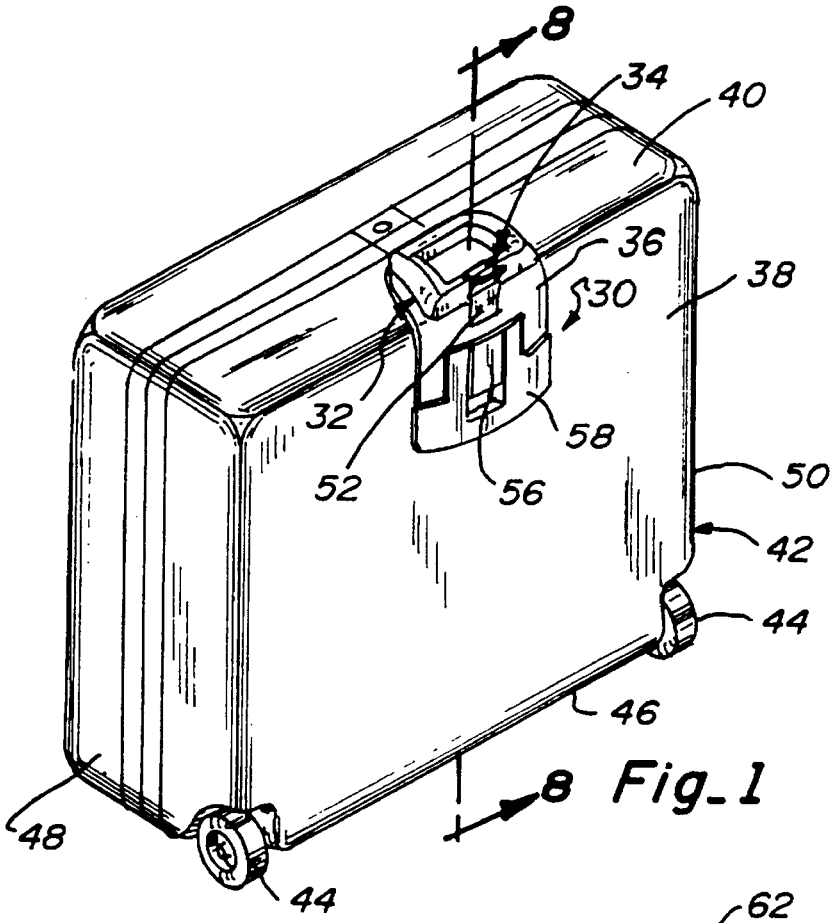
FIG. 1 is a perspective view of a wheeled luggage case incorporating an assembly of a selectively positionable maneuvering and carrying handle and an auxiliary luggage attachment and handle restraint device in accordance with the present invention.
Figure 3:
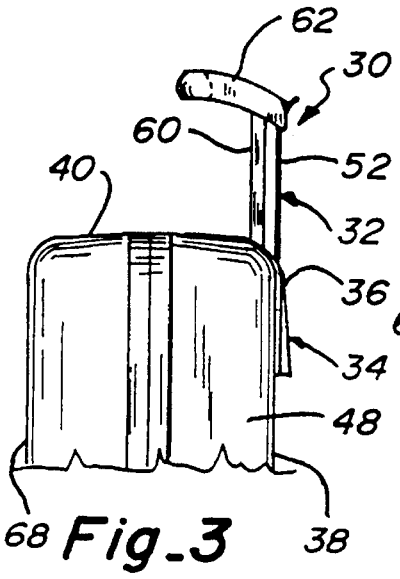
FIG. 3 is a partial end elevational view of the luggage case shown in FIG. 1, with the maneuvering and carrying handle in a partially extended position similar to that shown in FIG. 2.
Figure 2:
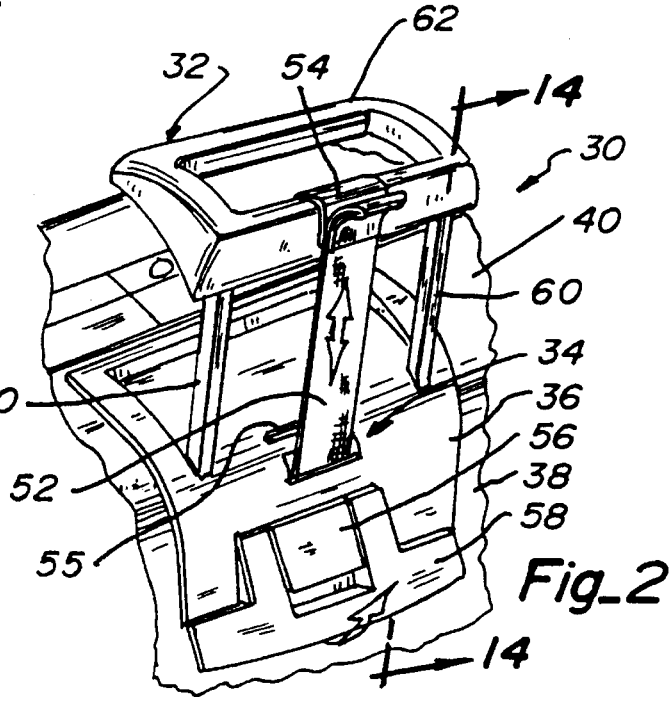
FIG. 2 is an enlarged partial perspective view of the assembly of the handle and restraint device shown in FIG. 1.

The present invention is embodied in an assembly 30 of a selectively extendable and retractable maneuvering and carrying handle 32 and an auxiliary luggage attachment and handle restraint device 34, as is shown generally in FIGS. 1–3. For convenience, the improved and interactive assembly 30 will be referred to herein as a handle and restraint assembly 30.

The handle and restraint assembly 30 is preferably housed in a cassette 36. The cassette 36 is connected to a major external face panel 38 and a top side 40 of a main luggage case 42. Wheels 44 are attached to the case 42 at an edge defined by the intersection of the exterior face panel 38 and a bottom side 46 of the case 42. The wheels 44 are positioned on the case 42 to rotate about a common rotational axis, preferably one extending transversely between ends 48 and 50 of the case.

The case 42 may be either of the conventional hard-sided construction having two relatively rigid external shells which face one another and are hinged together along the bottom side 46, or of a soft-sided construction (not shown) utilizing relatively flexible exterior panels for the face panels, sides and ends. In a soft sided construction the cassette 36 and the wheels 44 are operably connected to an interior frame structure which provides support for the case including the flexible exterior panels.

Figure 4:
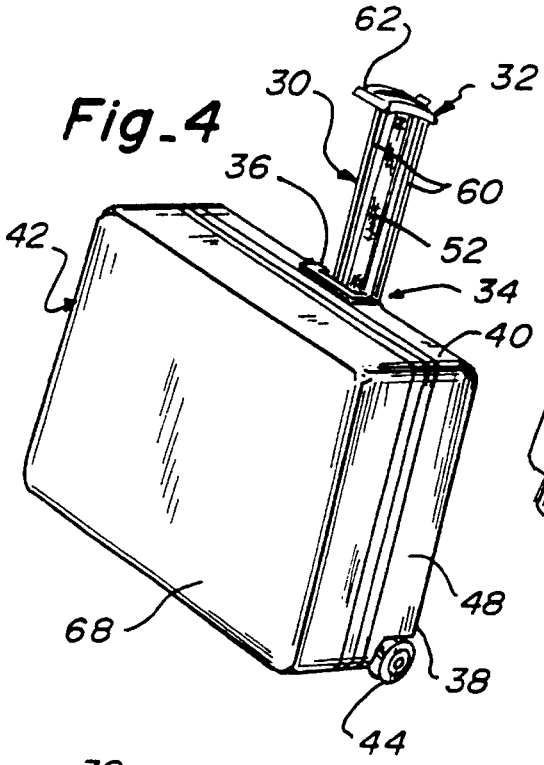
FIG. 4 is a perspective view similar to that shown in FIG. 1, taken from the opposite perspective and showing the case on its wheels, illustrating the pull handle and restraint device connected together and in an intermediate extended position for pulling the case.

The maneuvering and carrying handle 32 is selectively extendable from the cassette 36, as is shown in FIGS. 2–4. With the handle 32 in an extended position, the case 42 is levered onto its wheels 44 to a rolling position by a user gripping the extended handle 32. The degree of tilting or levering of the case 42 preferably places the majority of the weight of the case over the wheels 44. Tilted in this manner, very little effort is required by the user to maintain the case over the wheels 44. The user then pulls on the extended handle to move the case on its wheels along a support surface.

The handle and restraint assembly 30 allows the handle 32 to be selectively extended a relatively small distance, such as that shown in FIGS. 2 and 3 and used in this position as a carrying handle for lifting and suspending the case. When the handle 32 is used as a carrying handle, a belt 52 with a hook 54 at its outer end extends from the restraint device 34 in the cassette 36 to the handle 32 and restrains the handle from further extension. Restrained in this manner, the application of lifting force on the handle 32 allows the case 42 and its contents to be lifted and supported by the handle 32.

Figure 10:
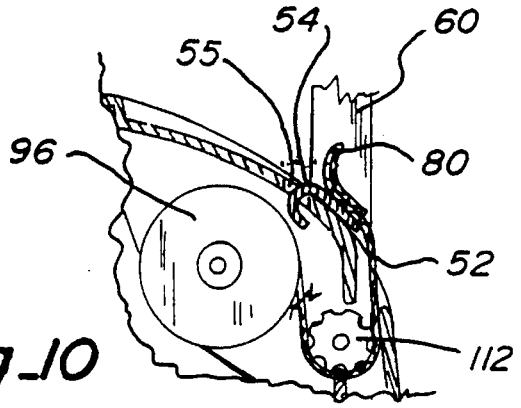
FIG. 10 is a partial section view taken substantially in the plane of line 10—10 of FIG. 5.

Normally the belt 52 of the restraint device 34 will be connected to the handle 32, even when the handle 32 is in the fully retracted position shown in FIG. 1. In the retracted position, the restraint device 34 prevents the inadvertent extension of the handle 32 as might otherwise occur during handling of the case 42. Alternatively, the belt 52 can remain in the retracted position when the handle 32 is in the extended position. A slot 55, as shown in FIG. 10, is formed in the cassette 36 into which the hook 54 can be inserted and connected to maintain the hook 54 in a retracted position regardless of the extended position of the handle.

Figure 5:
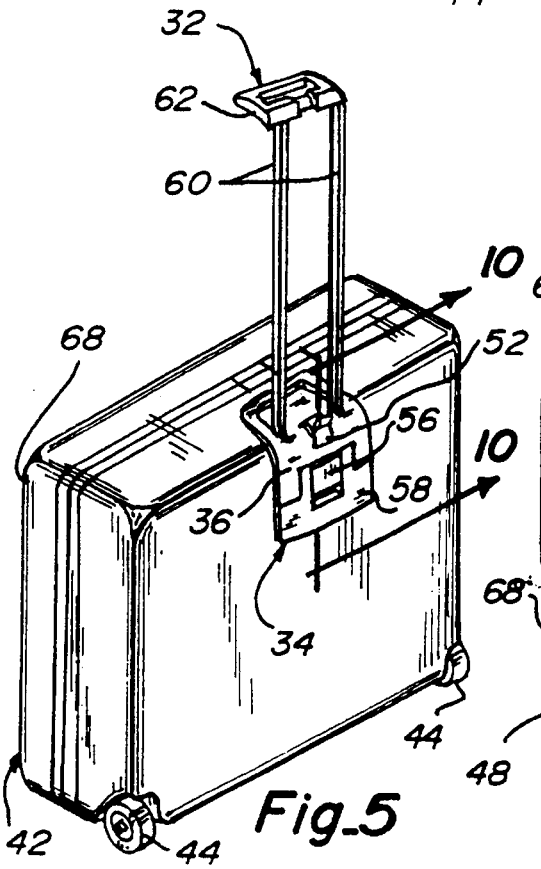
FIG. 5 is a perspective view of the luggage case shown in FIG. 1, illustrating the handle in a fully extended position and the restraint device in an independent fully retracted position.
Figure 6:
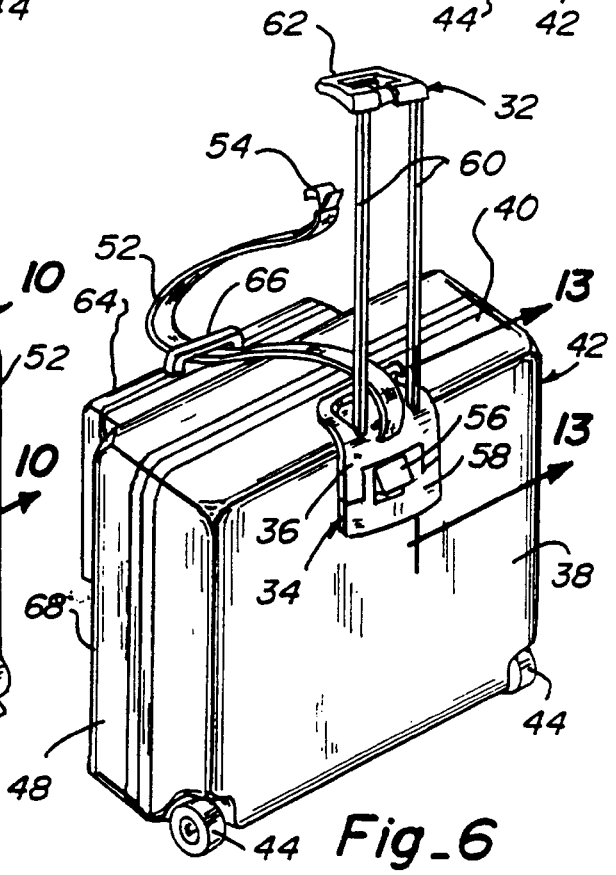
FIG. 6 is a perspective view similar to FIG. 5 illustrating the extension of a belt of the restraint device to connect a piece of auxiliary luggage to the main luggage case.
Figure 8:
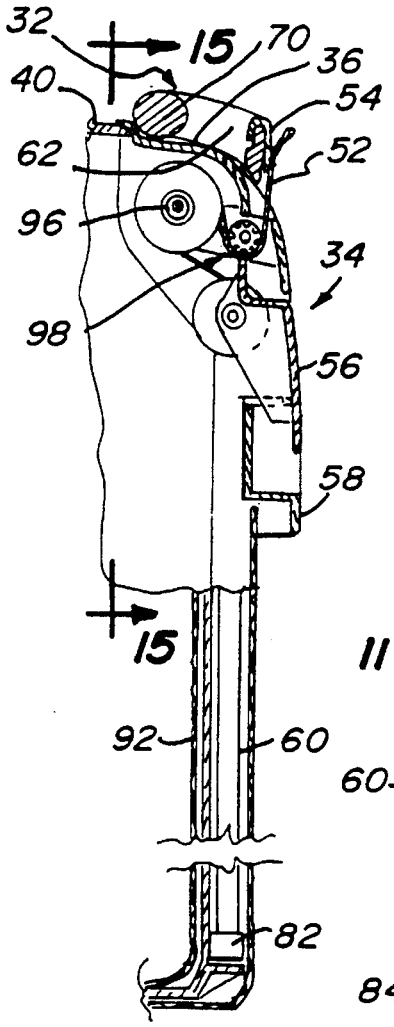
FIG. 8 is a partial section view with a portion broken out off the main luggage case, taken substantially in the plane of line 8—8 of FIG. 1.

To extend the handle 32, a belt release lever 56 must be pivoted by the user, as shown in FIGS. 2 and 6. Pivoting the belt release lever 56 releases the belt 52 of the restraint device 34 to allow the belt to extend from or retract into the cassette 36. As soon as the desired extended position is achieved, the belt release lever 56 is released, and further extension of the belt 52 from restraint device 34 is prohibited. Similarly, in order to retract the belt 52 into the restraint device 34 from an extended position, the belt release lever 56 is again lifted or pivoted. With no restraint on the belt 52, it will retract into the cassette 36, as shown in FIG. 5, by operation of the restraint device 34.

A handle release lever 58 is also connected to the exterior of the cassette 36 and functions to hold the handle 32 in a fully extended position and to release the handle from the fully extended position. In the fully extended position, the restraint device 34 operably contacts rods 60 which extend from and retract into the cassette. The rods 60 are connected at their outer end to a handpiece 62, thus completing the handle 32. The operable contact between the restraint device 34 and the handle rod 60 is maintained until the handle release lever 58 is pivoted upward as shown in FIG. 2. Upon pivoting the handle release lever 58, the operable retention established by the restraint device 34 and transmitted to the handpiece 62 by the belt 52 and the hook 54 is also released, because pivoting the handle release lever 58 also pivots the belt release lever 56. With the belt release lever 56 pivoted in conjunction with the handle release lever 58, the restraint supplied by the restraint device 34 through the belt 52 is terminated.

Figure 7:
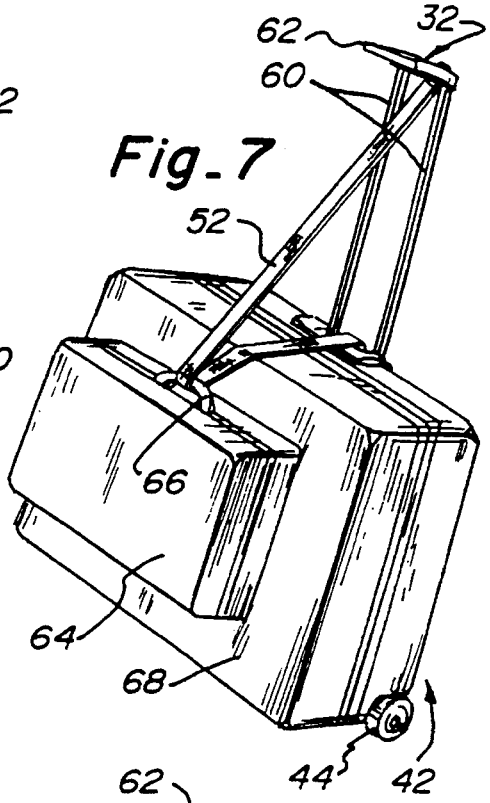
FIG. 7 is a perspective view of the luggage case shown in FIG. 6, taken from an opposite perspective, showing the main case on its wheels, the auxiliary luggage case supported on the main case, and connection of the auxiliary luggage case to the main luggage case by the belt of the restraint device.

The independent operation of the handle 32 and restraint device 34 by lifting the release levers 56 and 58 advantageously allows the belt 52 to be extended selectively and independently for the convenience of easily attaching an auxiliary luggage case 64 as shown in FIG. 6. The auxiliary luggage case 64 is placed next to the main luggage case 42, and the belt 52 is extended through a carrying handle 66 of the auxiliary case 64. Either before or after the extension of the belt 52, the handle 32 is extended to its maximally extended position. Once the belt 52 has been extended through the carrying handle 66, the hook 54 is connected to the handpiece 62 in the manner shown in FIG. 7. With the auxiliary luggage case 64 connected in this manner, with the belt 52 and the handle 32 in their extended position, the main luggage case 42 is levered onto its wheels 44 to lift both the auxiliary case 64 and the main luggage case 42 and to support the auxiliary case 64 on the upturned tilted exterior panel 68 of the case 42 while the case is pulled on its wheels 44 by the handle 32. The belt 52 can be selectively retracted into the cassette 36 when no auxiliary luggage is attached or connected and the handle 32 is in the maximally extended position, as shown in FIG. 5.

Details concerning the handle 32 of the handle and restraint assembly 30 are best understood by reference to FIGS. 8–14 and 21. The handpiece 62 includes a center grasping portion 70 which is located over the top side 40 at a position generally near the center of the case. With the grasping portion 70 located in this manner, the case is in a relatively balanced condition when the user grasps the handpiece 62 to lift the case and carry it by the handle 32.

Figure 21:
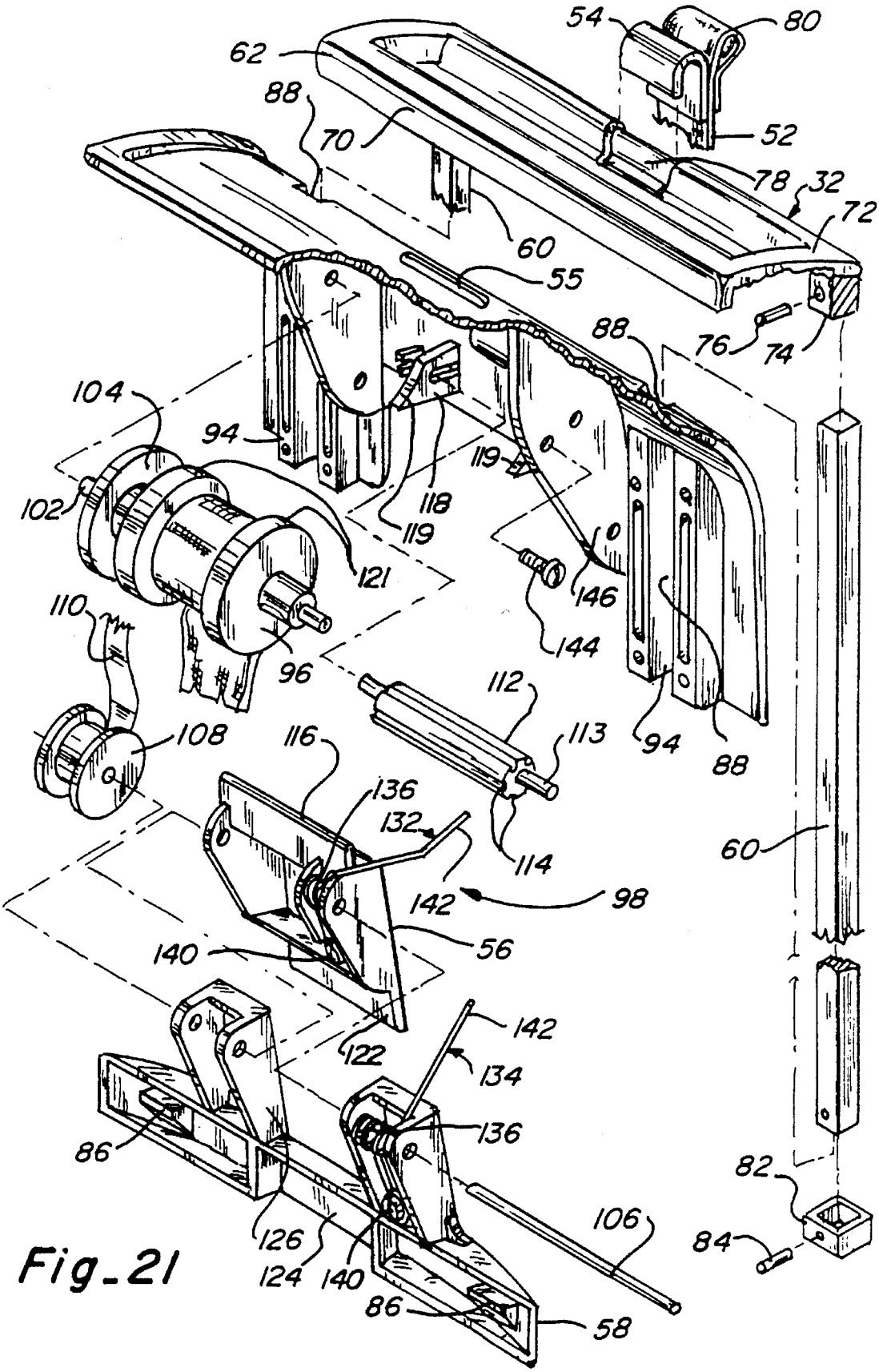
FIG. 21 is an exploded perspective view illustrating the major elements of the restraint device shown in FIGS. 15 to 20.

An attachment portion 72 of the handpiece 62 includes a rectangularly shaped socket 74 into which the upper ends of the rods 60 are retained, preferably by pins 76 (FIG. 21). Near the middle of the attachment portion 72, a receptacle 78 (FIG. 21) is formed. The receptacle 78 is shaped to receive the hook 54 attached to the end of the belt 52. The hook 54 connects to and is received within the receptacle 78. To release the hook 54 from the handpiece 62, or from the slot 55, a flap 80 (FIG. 10) on the outer end of the belt 52 is grasped by the user to lift the hook 54 off of the receptacle 78 or out of the slot 55.

Figure 9:
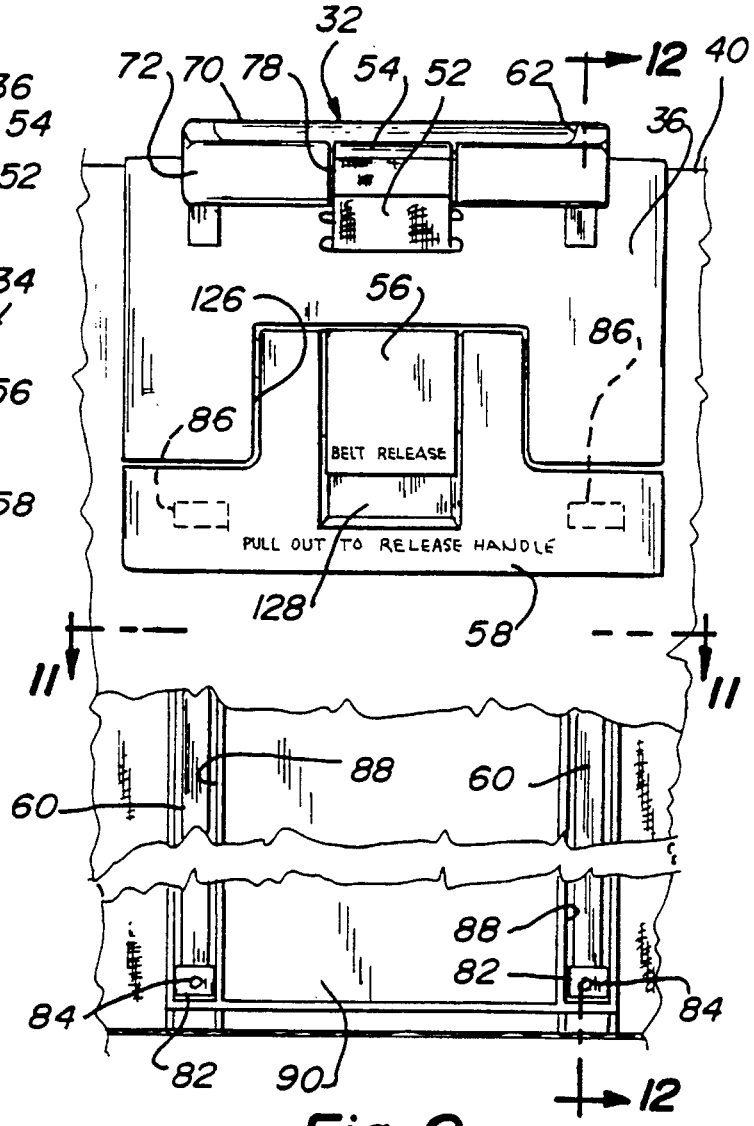
FIG. 9 is a partial side elevational view, with a portion broken out, of the handle and restraint device shown in FIG. 8.

A rectangularly shaped restraint sleeve 82 is attached to the lower end of each of the rods 60, preferably by a pin 84 (FIGS. 9 and 21). The restraint sleeves 82 interact with a restraint member 86 attached on the inner side of the handle release lever 58, as shown in FIGS. 9 and 12–14. With the handle 32 in the retracted position shown in FIGS. 9 and 12, the restraint member 86 contacts the exterior surface of the rods 60. When the handle 32 is extended to its maximally extended position, the restraint sleeves 82 ride over the restraint members 86 and the restraint members extend beneath the restraint sleeves 82 as shown in FIG. 13, thereby restraining the handle 32 in the maximally extended position.

Figure 14:
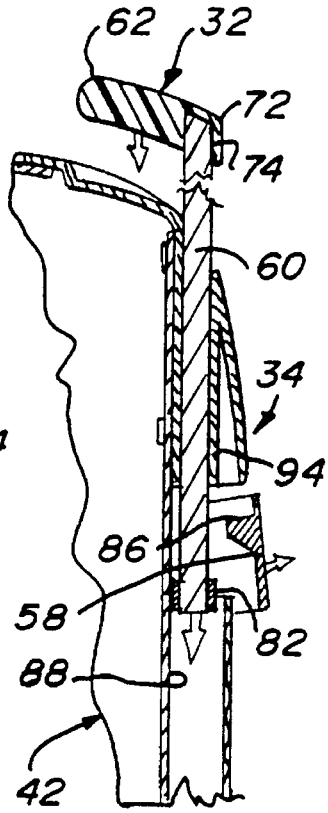
FIG. 14 is a partial sectional view similar to FIG. 13 taken substantially along section line 14—14 in FIG. 2, showing the release by the restraint mechanism of the handle to allow it to retract.

To release the handle 32 from the maximally extended position, the handle release lever 58 is pivoted outward as shown in FIG. 14. In this pivoted position the restraint members 86 move away from the bottom of the rods 60 and the restraint sleeves 82, thereby releasing the mechanical connection of the restraint device 34 to the handle 32, and allowing the handle to move to the retracted position.

Figure 11:
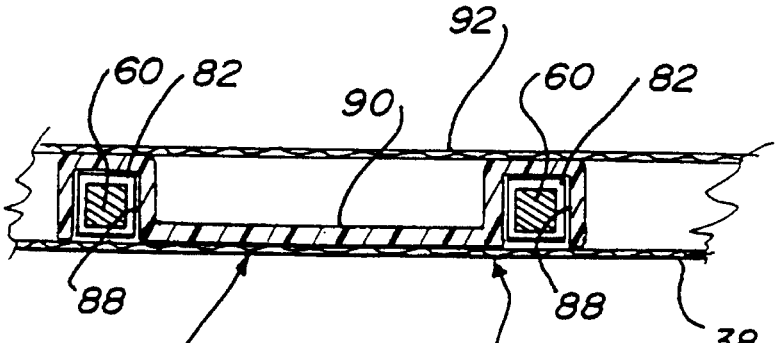
FIG. 11 is a partial section view taken substantially in the plane of line 11—11 of FIG. 9.

Each rod 60 is retained for movement within a tube 88, as shown in FIG. 11. Each tube 88 is formed in a general rectangular configuration of a size slightly larger than the exterior size of the restraint sleeves 82. Consequently the restraint sleeves 82 and the rods 60 can move along the length of the tubes 88. The tubes 88 are part of an internal structural component 90 of the cassette 36. The structural component 90 and the tubes 88 extend along the exterior face panel 38 on the interior of the case 42. On the inside of the case, a fabric or other suitable covering 92 hides the structural component 90 and other elements of the cassette 36 from the user's view. In soft-sided luggage cases, the structural element 90 may form an important integral portion of the internal frame structure necessary to support the exterior flexible panels in such soft-sided luggage.

Figure 12:
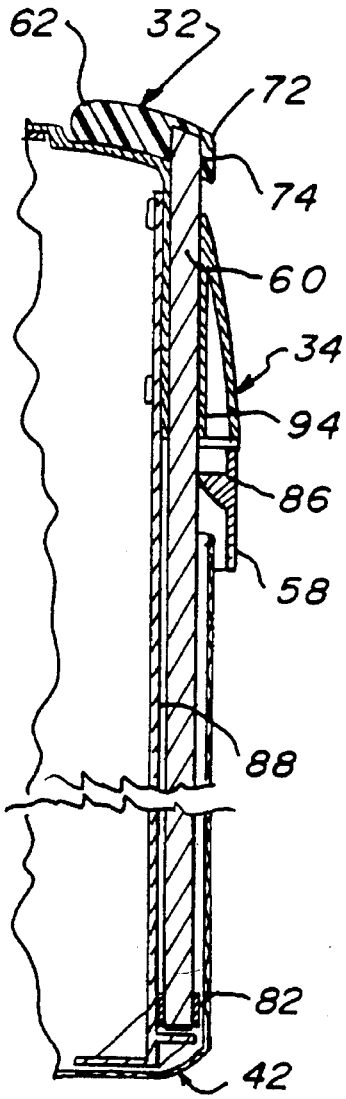
FIG. 12 is a partial section view with a portion broken out, taken substantially in the plane of line 12—12 of FIG. 9.
Figure 13:
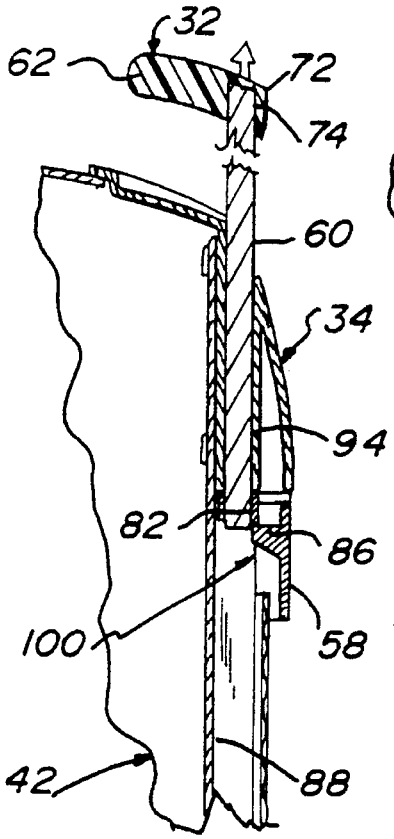
FIG. 13 is a partial sectional view similar to a portion of FIG. 12, taken substantially along section line 13—13 in FIG. 6, showing the restraint device holding the handle in its maximally extended position.

Each tube 88 includes an upper portion 94 having a rectangular cross-sectional shape which is slightly larger than the rectangular cross-sectional size of the rods 60, but not as large as the rectangular cross-section of the restraint sleeves 82, as shown in FIGS. 12–14. Consequently, the restraint sleeves 82 contact the upper portions 94 to prevent the handle from extending beyond its maximally extended position (FIG. 13). In this position, the restraint member 86 on the handle release lever 58 also contacts the bottom of the restraint sleeve 82, thereby rigidly fixing the handle 32 in its maximally extended position. Since the handle 32 cannot move further outward or inward in this position, the main luggage case 42 can easily be pushed by pushing on the handle 32 as well as being pulled in the conventional manner.

Figure 22:
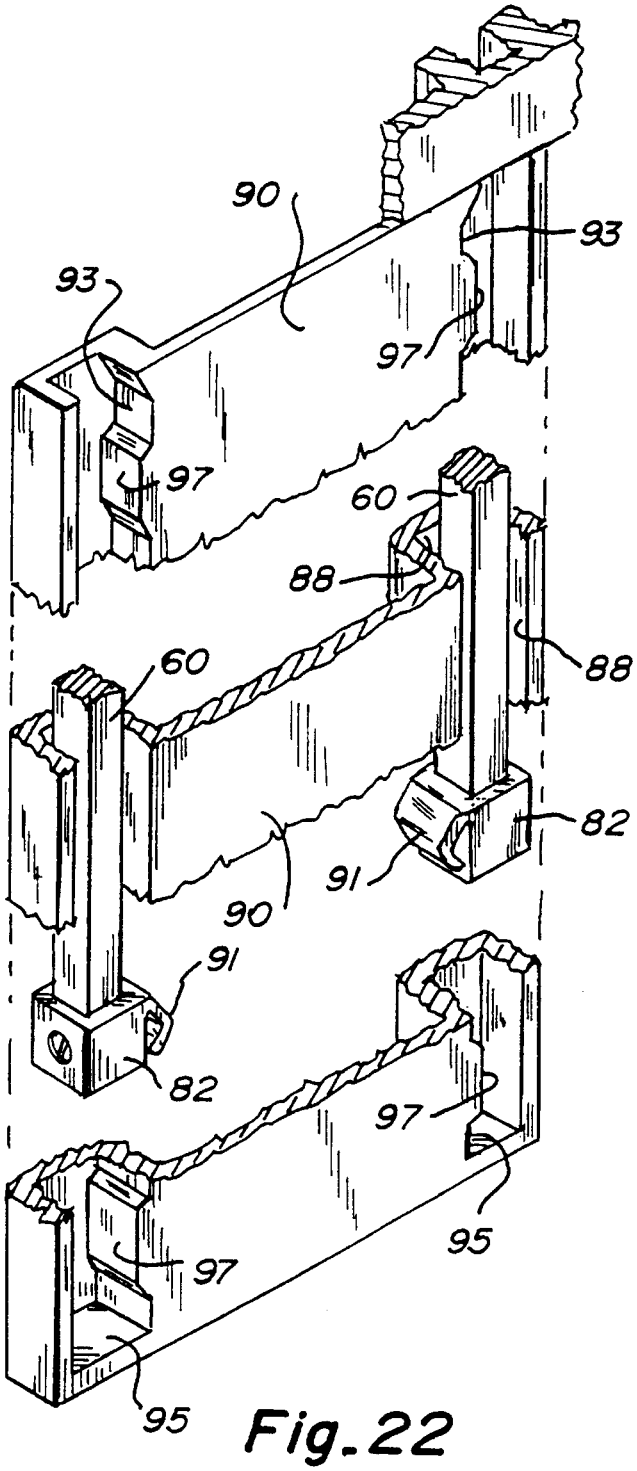
FIG. 22 is a partial perspective view of an optional feature of the handle of the assembly shown in FIGS. 8, 9, 11, 12 and 21.
Figure 23:
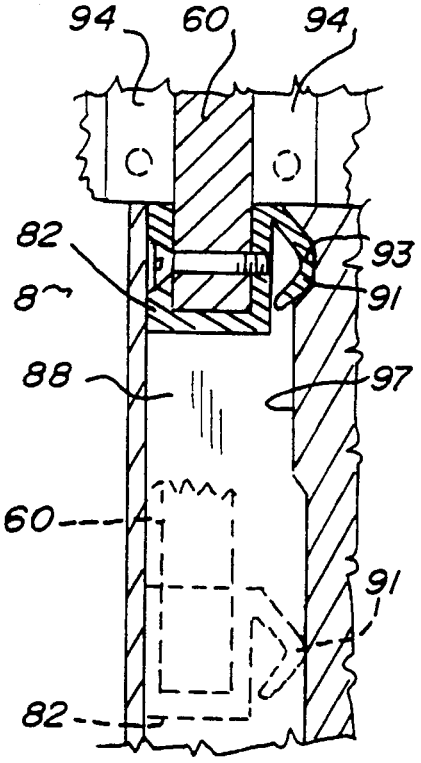
FIG. 23 is a partial section view through a portion of FIG. 22, illustrating one condition in solid lines and another condition in partial phantom.
Figure 24:
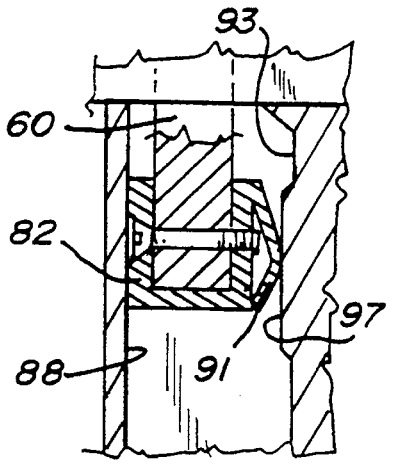
FIG. 24 is a partial section view similar to FIG. 23, illustrating another position of the elements shown in FIG. 23.

The restraint sleeve 82 and the tubes 88 may optionally include a resilient tab 91 and detents 93 and 95, as shown in FIGS. 22–24. The resilient tabs 91 on each restraint sleeve 82 extend inwardly toward the restraint sleeve 82 on the other rod 60. The detents 93 are formed in the tubes 88 at a position to receive the tabs 91 when the handle 32 is in a fully extended position (FIG. 23). The detents 95 are formed in the tubes 88 at a position to receive the tabs 91 when the handle 32 is in a fully retracted position. The engagement of the resilient tabs 91 with the detents 93 and 95 assist in securing the handle 32 in the maximally extended and fully retracted position, respectively.

Shoulders 97 are formed in the tubes 88 below the upper detents 93 and above the lower detents 95. The shoulders 97 cause the tabs 91 to compress inwardly as shown in FIG. 24 when the restraint sleeves 82 move into adjacency with the shoulders 97. The added force from compressing the tabs 91 to move them from the detents 93 and 95 over the shoulders 97 creates an additional force to maintain the position of the handle 32. However the added force from compression of the tabs 91 can be overcome with reasonable manual effort when retracting or extending the handle from the fully extended and fully retracted positions.

The tabs 91 also engage the sidewall of the tubes 88 with a frictional force when the handle is in an intermediate position between the fully extended and the fully retracted positions, as shown in phantom in FIG. 23. In the intermediate positions the tabs 91 experience a lesser amount of compression compared to that shown in FIG. 24. However the tabs 91 create an adequate amount of frictional force with the tubes 88 to maintain the rods 60 and handle 32 in a free standing intermediate position between the fully retracted and extended positions. This frictional force in the intermediate position alleviates the problem of the handle 32 and rods 60 retracting into the cassette 36 under the weight of the handle or from some other small force. As discussed below, the contact of the restrain member 86 with the rods 60 also contributes to or achieves sufficient frictional force to retrain the handle 32 in the intermediate positions.

Details concerning the restraint device 34 of the assembly 30 are best understood by reference to FIGS. 8 and 15–21. The primary components of the restraint device 34 are located behind an exterior of the cassette 36, generally in the vicinity of the intersection of the external face panel 38 and the top side 40 of the case 42, as well as behind the belt release lever 56 and handle release lever 58. The major components of the restraint device 34 include the belt 52, a belt take-up roller 96 upon which the belt 52 is coiled in both the extended and retracted positions of the belt, a belt clutch mechanism 98 which operably controls the extension and retraction of the belt 52 by allowing it to extend and retract and to restrain it in position, the belt release lever 56 which interacts with and forms a part of the belt clutch mechanism 98 to establish a free movement condition and a restrained condition of the belt, a handle clutch mechanism 100 (FIG. 13) which includes the handle release lever 58, the restraint member 86 formed on the back side of the handle release lever and the restraint sleeve 82 attached to the lower end of each rod 60 of the handle 32.

Figure 15:
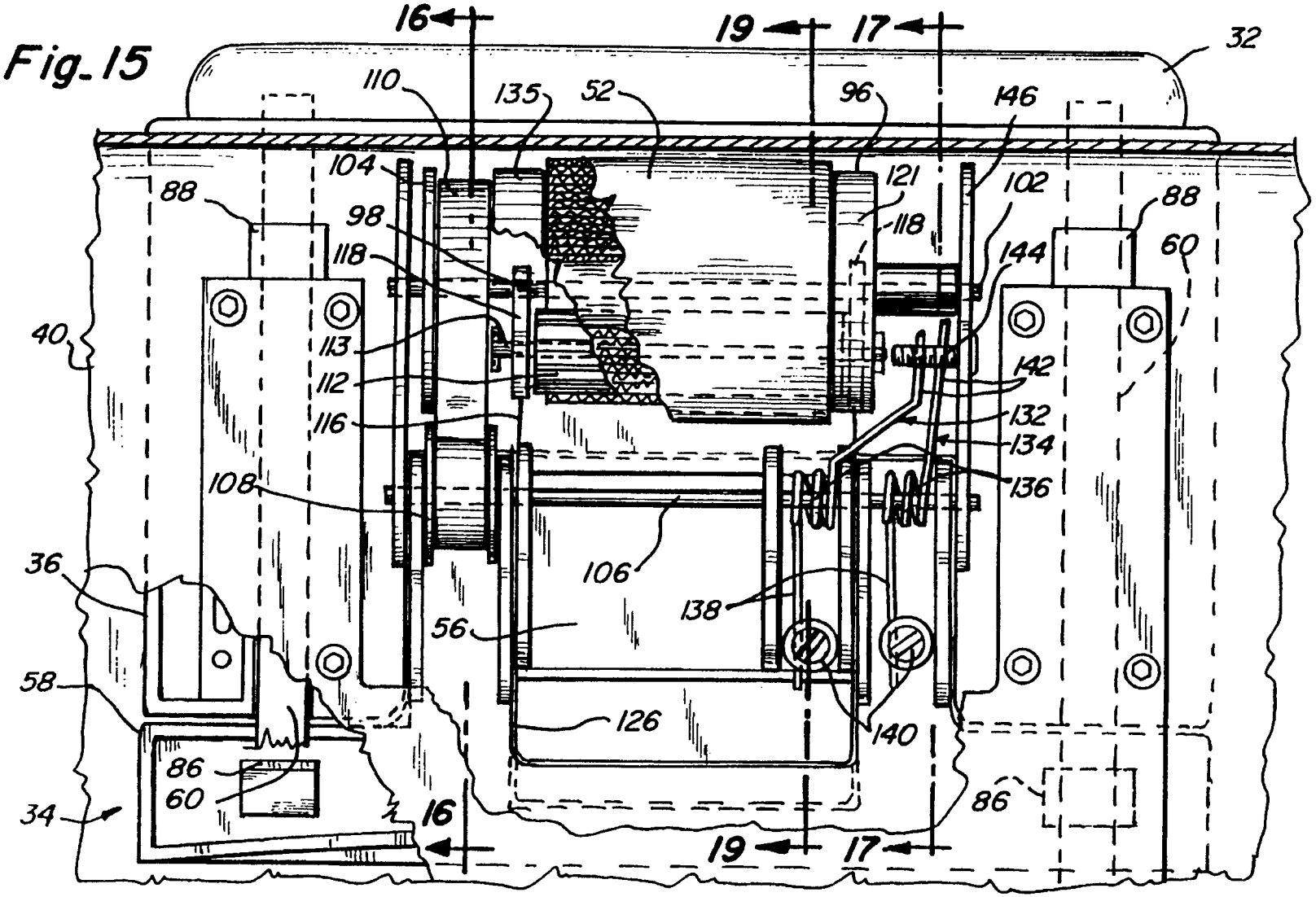
FIG. 15 is a partial section view taken substantially in the plane of line 15—15 of FIG. 8.

As is shown in FIG. 15, the back side of the cassette 36 includes a number of partitions, walls and other structural elements to position and hold the major components of the restraint device 34. These partitions, walls and other structural elements are formed generally between the tubes 88.

The belt take-up roller 96 is formed generally as a drum which is rigidly connected to a center shaft 102. A roller pulley 104 is also connected to the shaft 102 at a position adjacent to the roller 96. The pulley 104 is fixed to rotate with the shaft 102 and the take-up roller 96.

Figure 16:
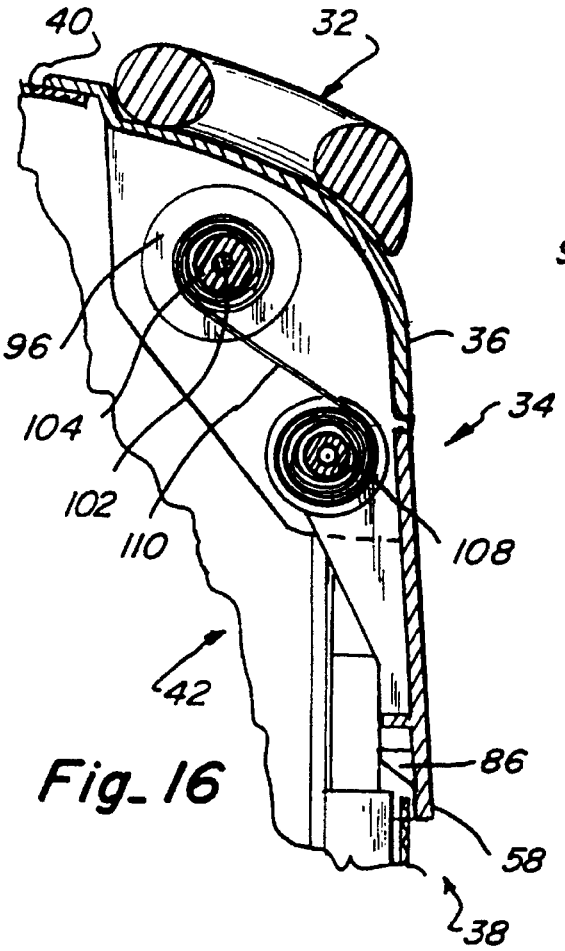
FIG. 16 is a section view taken substantially in the plane of line 16—16 of FIG. 15.

A pivot shaft 106 extends generally parallel to the shaft 102. A pivot shaft pulley 108 is rotationally connected on the pivot shaft 106 in transverse alignment with the pulley 104. The pivot shaft pulley 108 is free to rotate about the shaft 106. An elongated spring member 110 is connected at its ends and is counter wound around the roller pulley 104 and is forwardly wound around the pivot shaft pulley 108, respectively. As is shown in FIG. 16, the spring member 110 is wound in a clockwise direction around the pivot shaft pulley 108. The spring member 110 is bent in a permanent spring deformation to normally coil in the clockwise direction around the pivot shaft pulley 108, as shown in FIG. 16. When the spring member 110 is wound around the roller pulley 104, the direction of coiling is also in the clockwise direction, but is in a reverse or counter wound manner compared to the spring deformation of the spring member 110. The roller pulley 104, pivot shaft pulley 108, and spring member 110 configuration form a constant force spring.

Figure 17:
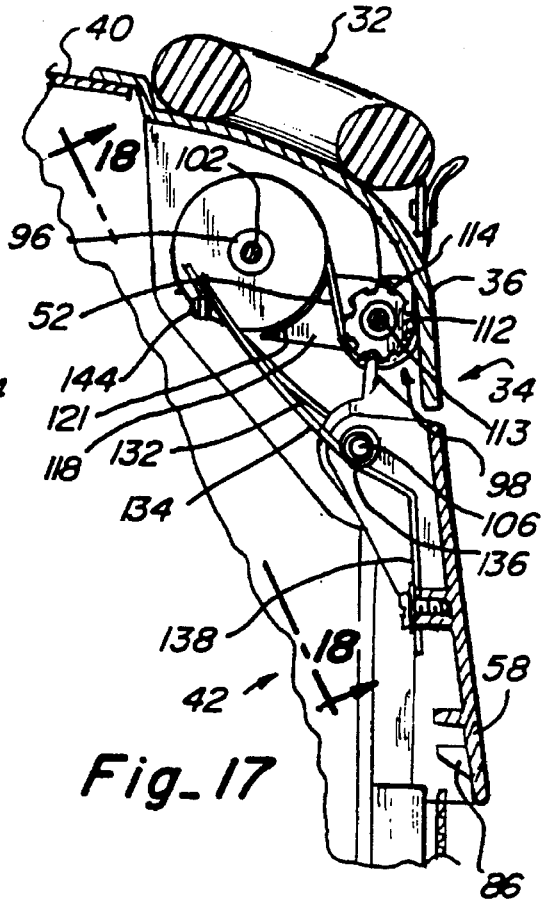
FIG. 17 is a section view taken substantially in the plane of line 17—17 of FIG. 15.
Figure 18:
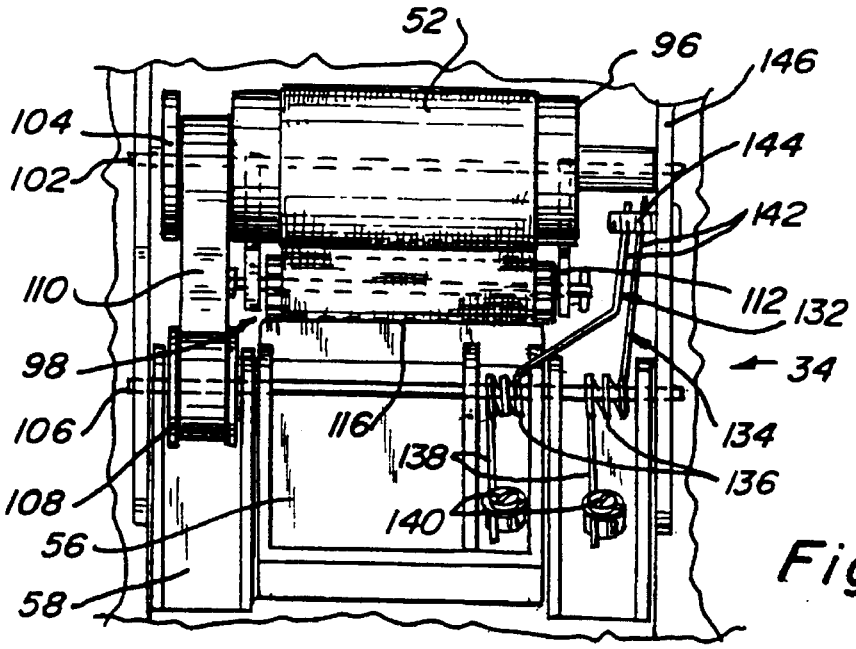
FIG. 18 is a section view taken substantially in the plane of line 18—18 of FIG. 17.

As a consequence of the spring deformation of the spring member 110, the pivot shaft pulley 108 will normally attempt to rotate in the clockwise direction as shown in FIG. 16. The roller pulley 104 will normally attempt to rotate in a counterclockwise direction, and while doing so rotate the belt take-up roller 96 with it. With the belt take-up roller 96 normally biased by the spring member 110 to rotate in the counterclockwise direction as shown in FIG. 17, the belt 52 will normally coil on the roller 96 in a manner to retract. This retraction occurs when the belt clutch mechanism 98 allows the belt to coil on the roller 96. The spring member 110 provides the tension force necessary to bias the belt 52 into and toward retraction.

The spring member which is forwardly wound around the pivot shaft pulley 108 and which is reverse wound around the roller pulley 104 creates a substantially constant tension force when the belt clutch mechanism 98 is released. The constant spring force achieved by the pulleys 104 and 108 and the spring member 110 is a convenience to the user as the belt is extended, since the same force is required to extend the belt both a slight distance as well as a greater distance. In addition, the belt may be retracted with a relatively constant force.

The belt clutch mechanism 58 includes a star shaped roller 112 which extends parallel to the shafts 102 and 106. The star roller 112 is allowed to freely rotate on a center shaft 113, and rotates in conjunction with the movement of belt 52, which extends over the star roller 112. Axially extending indentions 114 are formed in the exterior surface of the star roller 112 to give it the star shaped appearance in cross-section.

Figures 19, 20:
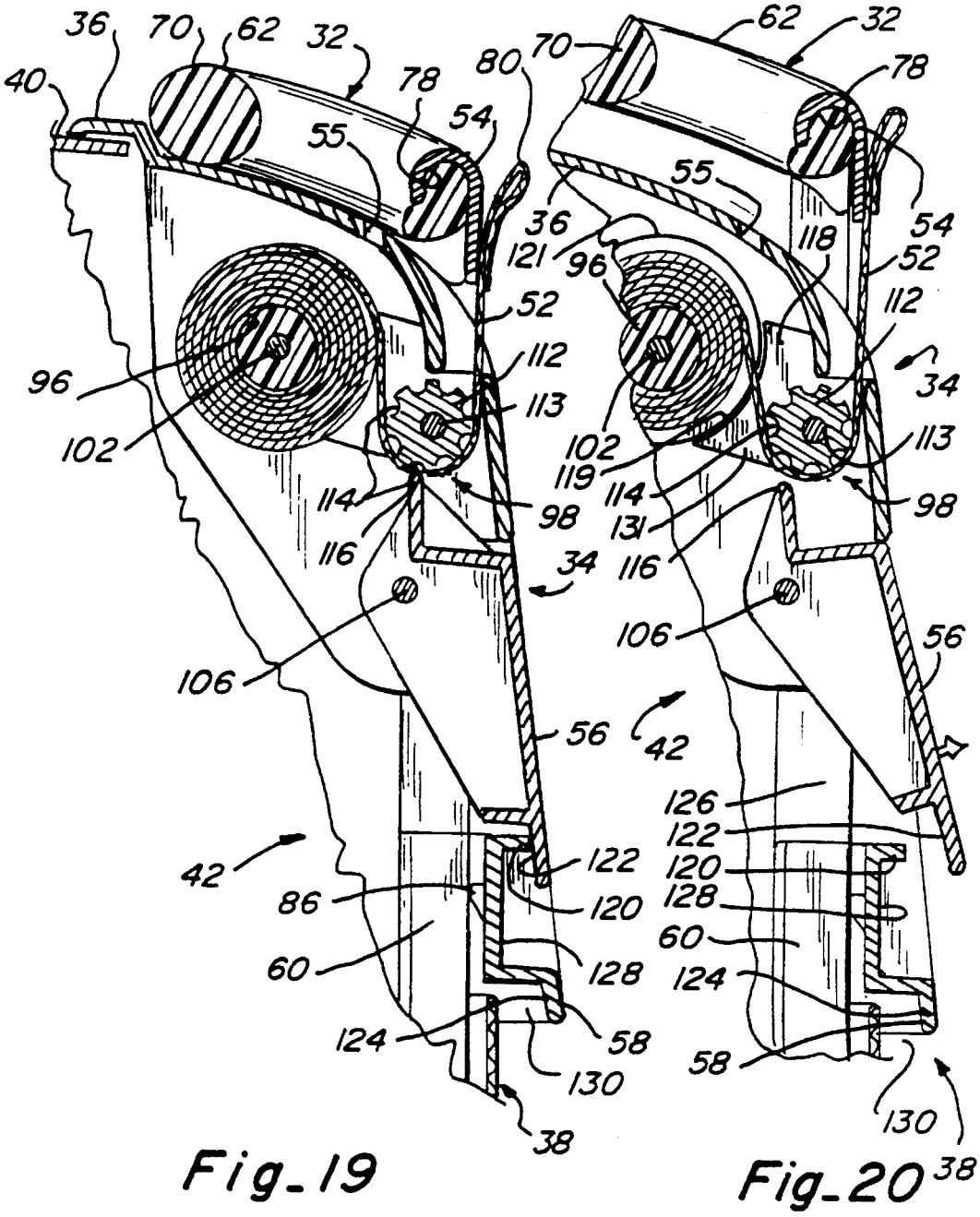
FIG. 19 is a section view taken substantially in the plane of line 19—19 of FIG. 15, illustrating the restraint of the restraint device to prevent the belt from extending.
FIG. 20 is a section view similar to FIG. 19 illustrating the release of the restraint device to allow the belt to extend.

A pawl 116 extends from the belt release lever 56 at a position to contact the belt 52 and force the belt into one of the indentions 114, when the belt release lever 56 is in a non-pivoted position as shown in FIGS. 17 and 19. The belt release lever 56 is connected to and pivots about the shaft 106. The location of the end of the pawl 116 relative to the center shaft 113 and the axis of rotation of the star roller 112 forms an off-center restraint, as shown in FIG. 19. Since the star roller 112 will normally rotate in the counterclockwise direction as shown in FIG. 19, and because the end of the pawl 116 which contacts the belt in the axial indentions 114 is located rotationally prior to a centerline between the shaft 106 and the center shaft 113, further attempts to extend the belt 52 will result in increased restraint of the pawl against the star roller 112. In this manner the star roller 112, the pawl 116 and the belt release lever 56 cause the belt clutch mechanism 98 to restrain the belt 52 against further extension. It is a result of this feature of the belt clutch mechanism 92 that allows the handle 32 to function as a carrying handle for the case. The belt clutch mechanism 92 sustains all of the weight of the case and its contents which is transferred through the belt 52 to the handpiece 62.

Although the off-center arrangement of the pawl 116 in the indentions 114 is primarily effective for restraining further extension of the belt 52, it is also effective in preventing retraction of the belt. The deformation of the belt 52 by the pawl 116 into one of the indentions 114 provides a sufficient force to inhibit retraction. However, the retraction restraint force is not nearly as effective or substantial as the restraint applied against extension of the belt.

To release the restraint applied on the belt 52, the belt release lever 56 is pivoted outward as shown in FIG. 20. In the pivoted position shown in FIG. 20, the end of the pawl 116 is withdrawn away from the belt 52 and out of the indentions 114 in the star roller 112. In this unrestrained condition, the belt 52 can be extended or retracted against the force applied by the spring member 110.

A pair of braces 118 extend inwardly from the exterior of the cassette 36 as shown in FIG. 17. The braces 118 each have an arcuate end 119 shaped to follow in close clearance to the exterior round surface 121 of the take-up roller 96. The braces 118 guide the belt 52 during retraction and extension to help insure proper alignment while being reeled onto or off of the take-up roller 96. The braces 118 also act as supports by abutting the exterior surfaces 121 of the take-up roller 96 when the force applied from the belt 52 onto the roller 96 is substantial. The arcuate shaped ends 119 of the braces 118 engage the edges 121 and minimize the deflection of the take-up roller 96 when the roller 96 is slightly deflected in position.

The handle release lever 58 is also pivotally connected about the shaft 106. The handle release lever 58 includes an outward extension 120 which contacts a back surface of a lip 122 formed on the lower end of the belt release lever 56, as shown in FIGS. 19 and 20. As a consequence, when a lip 124 of the lever 58 is gripped and pulled outward, the extension 120 also contacts the lip 122 of the lever 56, causing both levers 56 and 58 to pivot outward simultaneously. Since the belt clutch mechanism 98 is released to allow the belt to withdraw when the handle release lever 58 is pivoted outward (FIG. 2), it is assured that the belt 52 will retract into the cassette 36 at the same time that the handle 32 is retracted. Thus, there is no possibility that the handle 32 will retract when the belt 52 does not, unless the belt 52 is specifically restrained against such retraction.

The belt release lever 56 is positioned within an opening 126 formed in the handle release lever 58, as shown in FIG. 9. Positioning the lever 56 in the opening 126 of the lever 58 thus allows both levers 56 and 58 to pivot about the shaft 106. A depression 128 is formed in the handle release lever 58 at a position below and behind the lip 122 on the belt release lever 56 (FIGS. 19 and 23). The depression 128 allows the fingertips of the user to be inserted behind the lip 122 to pivot the belt release lever 56.

Similarly, a clearance 130 is formed in the exterior surface of the cassette behind and below the lip 122 at the bottom end of the handle release lever 58. The clearance 130 allows the fingertips of the user to be inserted therein to contact the lip 124 and pivot the handle release lever.

The handle clutch mechanism 100 is established by the handle release lever 58 and the restraint member 86 formed on the back of the release lever 58 opposite the depression 128. A separate restraint member 86 contacts each of the restraint sleeves 82 attached to the bottom of each rod 60, when the handle 32 is in its maximally extended position (FIG. 13). When the handle release lever 58 is pivoted outward, the restraint member 86 moves away from and clears the restraint sleeve 82 to allow the rods 60 of the handle 32 to be retracted into the tubes 88, as shown in FIG. 14.

The release levers 56 and 58 are held in a non-pivoted position by bias springs 132 and 134 respectively. Each bias spring includes a center coil portion 136 which surrounds the shaft 106. The ends of a lower arm portion 138 extending from each of the center coil portions 136 of the bias springs 132 and 134 are connected respectively to the belt release lever 56 and the handle release lever 58, preferably by screws 140. Upper arm portions 142 which extend from the center coil portions 136 of each bias spring 132 and 134 are connected to a rigid projection 144. The projection 144 is connected to a fixed structural partition 146 of the cassette 36.

The manner in which the arm portions 138 and 142 are deflected by the coil portions 136 cause the release levers 56 and 58 to be biased toward the clockwise position as shown in FIGS. 16, 17 and 19. However, the force applied from the bias springs 132 and 134 is not sufficient to prevent the user from conveniently pivoting the release levers 56 and 58.

When the handle 32 is extended to any position less than maximum extension, the bias force on the handle release lever 58 from the spring 134 causes the restraint members 86 to frictionally engage the sides of the rods 60 with enough restraint force to keep the handle 32 from retracting into the cassette 36 under the weight of the handle and rod. Thus the frictional force from the contract of the restrain members 86 with the rods 60 supplements the force from the slightly compressed tabs 91.

From the foregoing description, it is apparent that the assembly 30 of the handle 32 and restraint device 34 offers numerous advantages with respect to the extension and retraction of a single carrying and maneuvering handle and with respect to the extension and retraction of the auxiliary luggage attachment belt 52. Because the restraint device 34 allows the handle to be selectively positioned at intermediate locations between its retracted and maximally extended position, the handle 32 can be used as a carrying handle. The shape of the handpiece 62 positions the grasping portion 70 near a central location of the case to allow it to be balanced while carried by hand. The intermediate extended positions of the handle allow the user to conveniently adjust the handle to an optimal length short of its fully extended position while pulling the case on its wheels. When the handle 32 is in its maximally extended position, the belt 52 can be connected to it or it can be released to its retracted position. With the handle in its maximally extended position, the restraint device fixes the position of the handle so that the case can be maneuvered by either being pulled or pushed on its wheels.

The independent release and control of the attachment belt allows the to be extended and connected to the auxiliary luggage without the necessity of extending the handle. However, once the handle is extended and the hook end of the belt is connected to the handle, the position of the auxiliary luggage on the exterior upturned face of the main luggage case can be adjusted by taking up excess slack in the belt, and the belt clutch mechanism restrains the luggage in that position. Both the attachment of the auxiliary case and its support on the main case are facilitated by the independent control over the extension and retraction and the restraint of the belt 52. The use of two separately operable yet interconnected release levers 56 and 58 allows complete control over both the handle 32 and the belt 52 in all of the retracted and extended positions which they may assume.

A presently preferred embodiment of the invention and its many improvements and features have been described with a degree of particularity. This description is of the preferred example for implementing the invention. The scope of the invention should not necessarily be limited to this description, but instead should be defined by the scope of the following claims.

The invention claimed is:

1. A handle and restraint assembly for carrying and maneuvering a main luggage case having wheels, comprising:

a handle connected to the case which is selectively extendable into a maximally extended position, a fully retracted position, and any intermediate position between the maximally extended position and the fully retracted position, the handle including a handpiece for gripping the handle to carry the case and to maneuver the case on the wheels;

means for selectively restraining the handle in the maximally extended position in which to maneuver the case on the wheels; and a restraint device for selectively maintaining the handle in any intermediate position for carrying the case, said restraint device comprising:

means for frictionally preventing the handle from retracting from any intermediate position;

an elongated flexible element having a first end connected to the case and a second end attachable to the handle, said flexible element extendable to intermediate positions between a completely retracted position and a completely extended position;

means for releasably attaching the second end of the elongated flexible element to the handle; and clutch means, comprising roller means and pawl means, for selectively clamping the elongated flexible element between said roller means and said pawl means to prohibit the extension of the elongated flexible element in any intermediate position when the second end of the flexible element is attached to the handle.

2. An assembly as defined in claim 1 useable in connection with an auxiliary luggage case wherein:

the extendable elongated flexible element is wrapped at least partially around an element of the auxiliary luggage case, whereby the auxiliary luggage case may be connected to the main case when maneuvering the main case on the wheels.

3. An assembly as defined in claim 1 wherein the means for releasably attaching the second end of the elongated flexible element to the handle comprises:

a receptacle in the handle; and hook means receivable in the receptacle and attached to the second end of the elongated flexible element.

4. An assembly as defined in claim 1 wherein the clutch means for selectively clamping further comprises:

first lever means, operably connected to the pawl means and pivotable outward away from the main luggage case, for controlling contact of the pawl means with the elongated flexible element.

5. An assembly as defined in claim 4 wherein the means for selectively restraining the handle in the maximally extended position comprises:

a sleeve member upon the handle;

a shaft upon the case;

a second lever means, pivotable about the shaft, for controlling extension, retraction, and retention of the handle; and a restraint member protruding from the second lever means and selectively engageable with the sleeve member.

6. An assembly as defined in claim 5 wherein:

the clutch means for selectively clamping and the means for restraining the handle in the maximally extended position are separately operable to independently control the extension, retraction, and retention of the elongated flexible element and the handle, respectively.

7. An assembly as defined in claim 6 wherein:

the first lever means further comprises a lip and the second lever means further comprises an extension member, and the lip and the extension member are optionally contactable to cause the clutch means for clamping and the means for restraining the handle the maximally extended position to simultaneously control the extension, retraction, and retention of the elongated flexible element and the handle, respectively.

8. A handle and restraint assembly for carrying and maneuvering a main luggage case having wheels, comprising:

a rod selectively extendable from and retractable into the luggage case to any intermediate position between a maximally extended position and a fully retracted position;

a handpiece attached to the rod;

means for frictionally preventing the handle from retracting from any intermediate position;

an elongated flexible belt selectively extendable and retractable to a completely extended position, to a completely retracted position, or to any intermediate position between the completely retracted position and the completely extended position, said belt capable of carrying the weight of the main luggage case and having a first end and a second end, said second end connected to the main luggage case;

hook means for releasably attaching the first end of the flexible belt to the handpiece; and clutch means, comprising roller means and pawl means, attached to the case for selectively clamping the elongated flexible belt between said roller means and said pawl means to prohibit the flexible belt from extending to the completely extended position, the rod thus being held by the belt in an intermediate position when the first end of the belt is attached to the handpiece and the clutch means is clamping the belt.

9. An assembly as defined in claim 8, wherein:

the belt passes through the clutch means, and the clutch means is selectively engageable against the belt to fix the length of extension of the belt and is disengageable from the belt to allow the belt to retract and extend.

10. An assembly as defined in claim 8, further comprising:

means, attached to the main luggage case and to the second end of the belt, for selectively storing the belt in the retracted position and dispensing the belt to the extended position; and a spring means, attached to the storage means, for retracting the belt onto the storage means when the clutch means is not clamping the belt, regardless of whether the belt is attached to the handpiece.

11. An assembly as defined in claim 10, wherein the roller means comprises:

a star roller having a cylindrical shape, longitudinal axial indentations, and is freely rotatable about a longitudinal axis; and the pawl means comprises an elongated pawl selectively engageable and disengageable from any of the axial indentations, wherein the belt passes between the star roller and the pawl to become pinched between the pawl and the star roller when the pawl and roller are engaged, fixing the extension length of the belt, and wherein when the pawl is disengaged from the star roller the belt freely passes between the star roller and the pawl.

12. An assembly as defined in claim 11, further comprising:

a belt release lever attached to the pawl and pivotally attached to the main luggage case;

spring means for biasing the belt release lever toward the main luggage case to engage the pawl with the star roller; and wherein the belt release lever is pivotable away from the main luggage case to disengage the pawl from the star roller to allow the belt to extend or retract.

13. An assembly as defined in claim 12, wherein:

the means for biasing comprises a constant force spring.

14. An assembly as defined in claim 13, wherein:

the storage means comprises a take-up roller.

15. An assembly as defined in claim 12, further comprising:

means, attached to the luggage case, for releasably restraining the rod in the maximally extended position.

16. An assembly as defined in claim 15, wherein the means for releasably restraining the rod in the maximally extended position comprises:

a handle release lever pivotally attached to the luggage case;

a restraint sleeve attached to the rod;

a restraint member attached to the handle release lever;

means for biasing the handle release lever toward the main luggage case; and wherein the restraint member extends inwardly from the handle release lever and engages the restraint sleeve when the rod is in the maximally extended position, to hold the handpiece in a maximally extended position to allow the user to use the handpiece to push the luggage case on the wheels.

17. An assembly as defined in claim 16, wherein:

the restraint member automatically disengages from the restraint sleeve when the handle release lever is pivoted away from the luggage case, thereby allowing the rod to retract and move the handpiece from the maximally extended position to a retracted position.

18. A handle as defined in claim 16, wherein:

the first end of the belt passes through a handle of an auxiliary luggage case and is attached to the handpiece to suspend the auxiliary piece of luggage from the belt and support the auxiliary piece of luggage against the main luggage case for transportation.

19. An assembly as defined in claim 17, wherein:

the restraint sleeve contacts the luggage case when the rod is in the maximally extended position so that a user may grip the handpiece and therewith pull the luggage on the wheels without attaching the first end of the belt to the handpiece.

20. An assembly as defined in claim 17, further comprising:

a lip disposed upon the belt release lever; and an extension member disposed upon the handle release lever;

wherein the lip is engageable with the extension member such that each time the handle release lever is pivoted, the lip contacts the extension member and the belt release lever is pivoted to allow the handpiece and rod concurrently to retract from the maximally extended position; and wherein the belt release lever is pivotable independently of the handle release lever to allow the belt to retract or extend independently of the extension or retraction of the rod.

21. An assembly as defined in claim 17, wherein the hook means comprises a hook attached to the first end of the belt; and wherein said assembly further comprises a slot in the luggage case to receive the hook when the hook is not selectively attached to the handpiece.

22. A handle and restraint assembly for carrying a main luggage case, comprising:

a rod having a first end adapted to be selectively extended from and retracted to the main luggage case;

a handpiece attached to a first end of the rod for movement between a maximally extended position and a fully retracted position;

means for frictionally preventing the rod from retracting to the main luggage case;

a belt selectively extendable and retractable to a completely extended position, to a completely retracted position, or to any intermediate position between the completely retracted position and the completely extended position, said belt capable of carrying the weight of the main luggage case and having a first end adapted to be selectively attached to the handpiece and a second end connected to the main luggage case;

means for attaching the first end of the belt to the handpiece; and means, comprising roller means and pawl means, attached to the case for selectively clamping the belt between said roller means and said pawl means in any intermediate position to prevent the extension of the rod when the clutch means is clamping the belt and the first end of the belt is attached to the handpiece, so that a user can lift the handpiece and carry the luggage case suspended from the belt.

23. A handle and restraint assembly for carrying and maneuvering a main luggage case having wheels, comprising:

a handle, connected to the case, which is selectively extendable into a fully extended position, a fully retracted position, and any selected intermediate position between the fully extended and the fully retracted positions, the handle including a handpiece for gripping the handle to maneuver the case on the wheels;

a recess in the handpiece;

an elongated flexible belt, comprising a first end connected to the case and a second end;

a hook connected to the second end of the belt and engageable with the recess; and clutch means, attached to the case and comprising roller means and pawl means, for clamping the belt between the roller means and the pawl means when the handle is in the fully retracted position and the hook is engaged with the recess, to restrain the belt in a fully retracted position.

24. An assembly as defined in claim 23 wherein the belt is wrappable around at least a portion of an auxiliary luggage case, to connect the auxiliary case to the main case when the handle is in the fully extended position.

* * * * *